United States Patent [19]

Cox

[11] 4,427,255

[45] Jan. 24, 1984

[54] PLASTIC BASED GLASS HALOGEN LAMP

[75] Inventor: Charles W. Cox, Willoughby, Ohio

[73] Assignee: General Electric Company, Schenectady, N.Y.

[21] Appl. No.: 318,167

[22] Filed: Nov. 4, 1981

Related U.S. Application Data

[63] Continuation of Ser. No. 94,065, Nov. 14, 1979, abandoned.

[51] Int. Cl.[3] ..... H01J 5/54; H01K 1/46

[52] U.S. Cl. ..... 339/127 C; 339/144 R; 362/296

[58] Field of Search ..... 339/17 D, 125 L, 127 R, 339/127 C, 217 S, 144–146, 220 L; 313/318; 362/226, 296

[56] References Cited

U.S. PATENT DOCUMENTS

| | | | |
|---|---|---|---|
| 2,010,084 | 8/1935 | Howe | 339/145 R |
| 2,957,158 | 10/1960 | Kennett | 339/145 R |
| 3,047,829 | 7/1962 | Mouat | 339/145 R |
| 3,219,965 | 11/1965 | D'Adamo | 339/145 T |
| 3,243,634 | 3/1966 | Mosby | 313/285 |
| 3,469,140 | 9/1969 | Buttone et al. | 313/318 |
| 3,500,287 | 3/1970 | Heath | 339/17 D |
| 3,548,364 | 12/1970 | Hennessey | 339/145 T |
| 3,631,379 | 12/1971 | Wright | 339/145 R |
| 4,139,794 | 2/1979 | Malm et al. | 313/220 |
| 4,282,565 | 8/1981 | Hanson et al. | 362/267 |
| 4,287,448 | 9/1981 | Bradley | 313/113 |

FOREIGN PATENT DOCUMENTS

| | | | |
|---|---|---|---|
| 880873 | 1/1943 | France | 339/220 L |
| 567798 | 3/1945 | United Kingdom | 339/217 S |
| 686513 | 1/1953 | United Kingdom | 339/144 R |

*Primary Examiner*—Neil Abrams

*Attorney, Agent, or Firm*—John F. McDevitt; Philip L. Schlamp; Fred Jacob

[57] ABSTRACT

This invention relates to glass halogen lamps and more particularly to a glass halogen lamp having contact blades which are inserted within openings in a plastic base for permanently securing the lamp in referenced position to the base. The base has a generally cylindrical exterior configuration with a mediately disposed rim and a set of forwardly disposed locking ears which, when the base is inserted within a reflector, respectively engage the exterior and interior reflector surfaces to secure the lamp to the reflector.

8 Claims, 2 Drawing Figures

PLASTIC BASED GLASS HALOGEN LAMP

This is a continuation of application Ser. No. 94,065, filed Nov. 14, 1979, now abandoned.

This invention relates to glass halogen lamps and more particularly to a glass halogen lamp having contact blades which are inserted within openings in a plastic base for permanently securing the lamp in referenced position to the base. The base has a generally cylindrical exterior configuration with a mediately disposed rim and a set of forwardly disposed locking ears which, when the base is inserted within a reflector, respectively engage the exterior and interior reflector surfaces to secure the lamp to the reflector.

BACKGROUND OF THE INVENTION

Halogen lamps are compact, efficient light sources which are useful in numerous applications. However, halogen lamps operate at high temperatures (approximately 250°–400° C.) and useful application of the halogen lamp is often difficult, and is generally expensive from both a material and labor standpoint. The molybdenum leads provided on some halogen lamps are subject to oxidation and too flexible to independently support the lamp. The lamp must be potted with cement to secure it within a ceramic reflector or socket. The cement has a tendency to flow onto and insulate the exposed lamp terminals causing poor electrical connections. Additionally, potted halogen lamps which are encased in ceramic materials are subject to high mechanical stresses created by the thermal cyling of the lamp between 0°–400° C.

Other halogen lamps employ rigid nickel alloy outer leads which are less susceptible to oxidation. These leads, although useful in locating a lamp in spaced relation relative to a ceramic support, require the lamp to be referentially positioned by the exterior ends of lead wires. The lead wire ends are generally secured within rigidly disposed electrically conductive sleeves which structurally support and electrically connect the lamp. Although the halogen envelope is spaced from the ceramic socket and is thus isolated from thermally induced mechanical stresses, the bulb requires additional contacts to externally electrically connect the lamp. Multiple contacts, in addition to being material and labor intensive, increase the resistance of the contacts and their susceptibility to oxidation. Additionally, the conductive sleeve supports have positional tolerances which require each halogen lamp to be individually referenced.

SUMMARY OF THE INVENTION

The plastic based halogen lamp of the present invention provides an assembly which accurately and rigidly disposes a halogen lamp in a predetermined position with a base for subsequent application to a reflector.

The lamp lead wires positionally reference and structurally support the lamp and provide external lamp connections which are integral with the lamp lead wires. The external connections are less susceptible to oxidation and the plastic based halogen lamp provides a highly accurate, inexpensive assembly for mounting a halogen lamp in predetermined relation with a reflector. Portions of the outer lamp leads are reconfigured, by for instance flattening, to provide shoulder references for inserting the halogen lamp in predetermined relation within the plastic base. The shoulders act as references for positioning the halogen lamp. The plastic base includes restricted openings for receiving the flattened portions of the lead wires therethrough while excluding the unworked portions. The lamp lead wire shoulders engage precisely molded, accurately positioned complementary seats in the plastic base and thereby effect the altitudinal positioning of the lamp relative to the base. The base channels are configured to snugly engage the flattened portions of the lead wires and thereby prevent rotational movement of the lamp within the base.

The exterior of the base is further configured to lockingly engage a reflector opening and dispose the lamp in a predetermined relation with the reflector. The base in one embodiment has a substantially cylindrical outer configuration with a mediately disposed rim and a set of forwardly disposed ears. When the base is inserted within a reflector, the rim and ears respectively engage the rear exterior and interior surfaces of the reflector. The rim and ears in one embodiment are formed in approximately parallel planes which are separated by approximately the thickness of the reflector wall to snugly engage the reflector surfaces or in an alternate embodiment are spaced slightly greater than the thickness of the reflector wall to include a resilient bias means such as a sealing gasket between the base rim and the rear reflector surface. Accordingly, the plastic based halogen lamp provides a lightweight inexpensive assembly for quickly, efficiently, and replaceably positioning a bulb in preferred relation with a reflector.

The flattened or blade portions of the lead wires extend through the base and are directly utilized as external contacts for electrically connecting the internally predisposed halogen bulb.

The rear exterior of the base is configured to impart strength and rigidity to the base as well as provide sufficient structure for lockingly engaging a socket.

The lead wire shoulders enable the halogen bulb to be accurately positioned within the base without the additional electrical contacts or the potting cements of prior mountings.

The base ears upon insertion within the reflector engage in abutting relation, stops on the interior reflector surface to align the filament in cooperative relation with the reflector.

The flattened portions of the lead wires, in combination with the resulting shoulders, enable the halogen bulb to be positioned in spaced relation from the base to effect ventilated operation of the bulb and thus reduce thermal stresses on the bulb envelope and the reflector enclosure.

The plastic based halogen lamp of the present invention is easily handled and provides for the ready application of a halogen bulb to a variety of reflectors and thus enables the wide spread and replaceable use of the halogen bulb.

Further objects and features and a more complete understanding of the present invention will be apparent from the following detailed description which taken in conjunction with the drawings represent the preferred embodiment of the invention.

DETAILED DESCRIPTION OF THE DRAWINGS

Figure 1:
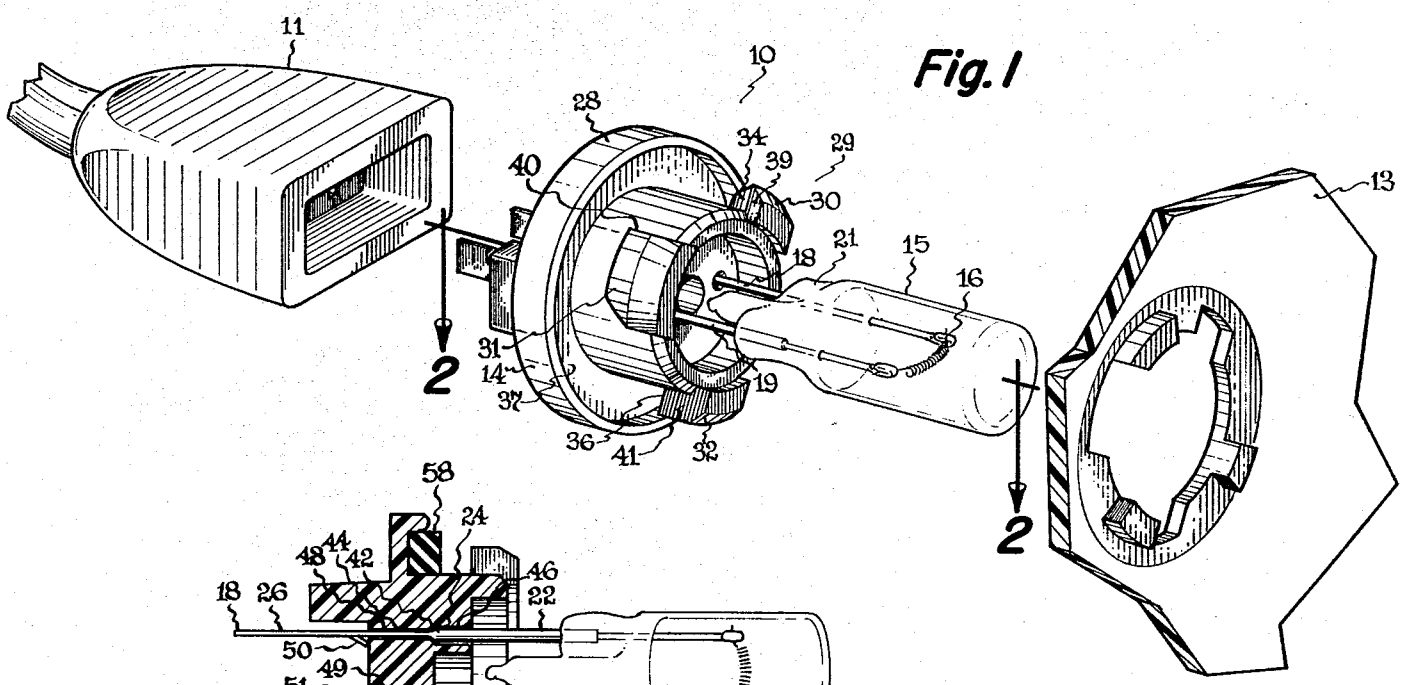
FIG. 1 is an exploded perspective view of the based halogen lamp of the present invention as used in combination with a socket connector and a reflector.

Referring now to FIG. 1, the based halogen lamp 10 of the present invention is shown in exploded perspective view in combination with a socket 11 and a reflector 13. The based halogen lamp 10 generally comprises a nickel alloy lead wire halogen lamp 15 disclosed for instance in U.S. Pat. Nos. 3,270,273 to Danko, and 3,798,491 to Malm, assigned to the assignee of the present invention and incorporated herein by reference. The halogen lamp 15 is permanently secured, in predefined relation, to a plastic base 14. The halogen lamp 15 is produced with a filament 16 disposed in known relation relative to ends of lead wires 18 and 19 respectively. End referencing is inappropriate for most applications inasmuch as the lamp lead wires, once positioned, can no longer be externally accessed to, for instance, effect subsequent external connection of the lamp. End referenced lead wires have heretofore been electrically connected and rigidly disposed within an electrically conductive connector to enable further electrical connection of the lamp. Such connections are expensive in both labor and material. The based halogen lamp 10 of the present invention enables the direct use of the lead wires 18 and 19 for external electrical connection. The cost of the base 14 is offset by the labor and material costs of the prior art as well as by the enhanced ease of handling afforded by the base 14.

The lead wires 18 and 19 are securely supported within the lamp envelope pinch seal 21 and have sufficient rigidity to independently support the halogen bulb 15. The lead wires 18 and 19 have generally cylindrical upper portion 22 and 23 and flattened or blade like lower portions 26 and 27. In a preferred embodiment the lower portions 26 and 27 are formed by for instance stamping or rolling the leads flat. The flattening process establishes transition portions or shoulders 24 and 25 in each lead which are subsequently used to position the lamp relative to the base with a high degree of precision. The filament references, formerly the tips of the lead wires 18 and 19, are reformed as shoulders 24 and 25 which are mediately disposed on the lead wires 18 and 19. The shoulders 24 and 25 enable the lower lead wire blades 26 and 27 to be used to effect external electrical connection of the lamp 10. Although the lower lead wires 26 and 27, in a preferred embodiment, have been flattened in opposed parallel planes, it is equally possible for the lead wires to be otherwise configured provided such configuration establishes the reference shoulders 24 and 25 on the lead wires 18 and 19 respectively. Flattening in opposed parallel relation is particularly useful in that the portions of leads 18 and 19 which project through the base 14 are readily received within a variety of sockets 11. In an alternate embodiment flat or bent blades 26 and 27 are soldered or welded to the lead wires 18 and 19.

The bladed lead wires 18 and 19 of the lamp 15 are inserted within a precision molded base 14 which is formed from high temperature plastic (having a melting point sufficient to withstand the heat produced by the lamp operation or approximately in excess of 150° C.) which in a preferred embodiment is Ryton plastic manufactured by Philips Petroleum. The base 14 is formed in a generally cylindrical external configuration having a mediately disposed rim 28 and set of forwardly disposed ears 29 which, upon insertion of the base 14 in the reflector 13, respectively engage the exterior and interior surfaces thereof.

The ears 29 in a preferred embodiment comprise three outwardly projecting blocks 30, 31 and 32 having lower surfaces 34, 35 and 36 in approximately parallel relation with the upper surface 37 of the rim 28. The ears 29 are further provided with stop surfaces 39, 40 and 41 which upon insertion within the reflector 13 contact complementary stops (not shown) on the interior surface of the reflector 13. In a preferred embodiment the stop surfaces of the ears 29 are perpendicular to the axis of the based lamp 10 and stop surfaces of the reflector 13 are perpendicular to the axis of the lamp reflector. Further the plane of the upper rim surface 37 and the lower ear surfaces 34, 35 and 36 are, in a preferred embodiment, approximately perpendicular to the axis of the based lamp 10 and the plane of the rear surface of the reflector 13 is approximately perpendicular to the axis of the lamp. Accordingly, insertion of the plastic based lamp 10 within the opening of the reflector 13 aligns the lamp axis with the reflector axis.

Figure 2:
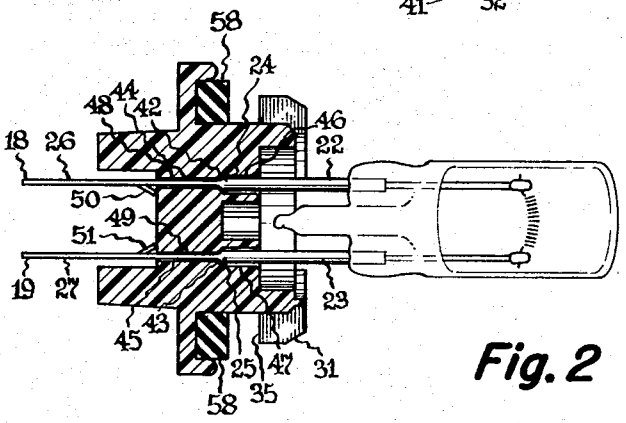
FIG. 2 is cross sectional view of a base in accordance with the present invention.

Referring now to FIG. 2, the based lamp 10 of the present invention is shown in cross section. The base 14 is provided with interior channels 44 and 45 for receiving lead wires 18 and 19 therethrough. The channels have open upper portions 46 and 47, restricted lower portions 48 and 49 and shoulder seats 42 and 43. The bladed portions 26 and 27 of the lead wires 18 and 19 are respectively inserted within the restricted lower channel sections 48 and 49. The lead wire shoulders 24 and 25 engage their respective channel seats 42 and 43 and establish the altitudinal position of the lamp 15 relative to the base 14. Although the channel seats 42 and 43 are shown mediatedly disposed within the channel 44 and 45, in alternate embodiments the channel seats 42 and 43 are located at the anterior and posterior ends of the channel 44 and 45. The lead wires shoulders 24 and 25 would then be located along the lead wires 18 and 19 such that engagement between the opposed lead wire shoulders and channel seats 24 and 42 and 25 and 43, positions the lamp filament 16 at the desired location relative to the base 14 which position can for instance be referentially related to the focus of the reflector or other selected location.

The restricted lower channel portions 48 and 49 in a preferred embodiment have rectangular cross sections which snugly engage the surfaces of the bladed lead wires 26 and 27 to securely locate the lamp 15 in the plane of the base and oppose rotational movement of the lead wires 18 and 19 within the base 14.

The lead wires 18 and 19 can be secured within the base 14 by for instance cement. However in a preferred embodiment the lead wires 18 and 19 are provided with tabs 50 and 51 for securing the lamp 15 to the base 14. More particularly the tabs 50 and 51, in one embodiment, are located on the bladed lead wires 26 and 27 at the locations where the blades 26 and 27 exit the rear of the base 14. The tabs 50 and 51 lockingly engage the rear exterior surface of the base 14. In an alternate embodiment the tabs 50 and 51 are mediately disposed on the bladed leaded wires 26 and 27 and engage the walls of the restricted base channels 48 and 49. The lead wires 18 and 19 are thus prevented from being withdrawn or forced backward through the base channels 44 and 45.

It will be appreciated that the present invention provides a simple and economical assembly for securing a halogen lamp 15 in a known and desired relation with a reflector 13. Although the present invention has been described with reference to a nickel alloy lead wire halogen lamp 15 it is readily apparent that the plastic base 14 of the present invention may be used in combination with other lamps having rigid lead wires wherein precise positioning is desired. In the particular motor vehicle running light environment, the based lamp of the present invention yields surprising advantages. The based lamp provides for a quick, easy and inexpensive means to either permanently or replaceably secure a lamp 15 in referenced postion within a vehicle reflector 13.

In a further embodimemt base 14 is employed in combination with a sealing ring 58 located forward of the stop rim 28.

Although the invention has been described in its preferred form with a certain degree of particularity, it is understood that the present disclosure of the preferred embodiment is made by way of example and that various modifications in the details of construction may be resorted to without departing from the true spirit and scope of the invention. It is intended that the patent shall cover, by suitable expression in the appended claims whatever features of patentable novelty exist in the invention disclosed.

What is claimed is:

1. An unsealed reflector lamp assembly having a replaceable based halogen lamp lockingly engaged in focused position to a reflector comprising, in combination, an electrically insulating base, said lamp having a bulb containing a filament and having lead wires for said filament extending outwardly from said bulb in mutual parallelism and providing sole support of the lamp in said base, said lead wires having intermediate portions integrally formed with fixedly positioned preformed shoulders formed from the material of said lead wires and spaced a first predetermined reference distance from said filament, said base having interior channels through which said lead wires extend, said channels being integrally formed with seat portions located at a predetermined internal position along the length of said channels and complementary to and engaging said lead wire shoulders for positioning said filament a second predetermined reference distance from said base and positioning said bulb in spaced relation from said base; said base having exterior projecting ear means precisely located with respect to said channel seat portions and which serve to reference said base to the focus of the reflector when said based halogen lamp is lockingly engaged to said reflector.

2. The lamp assembly of claim 1 wherein said base is formed from a thermoplastic.

3. The lamp assembly of claim 1 wherein the portions of said lead wires extending through said interior channels of said base are blades.

4. The lamp assembly of claim 1 wherein said lead wires are formed from nickel alloy.

5. The lamp assembly of claim 4 wherein said lead wires are formed from nickel iron alloy.

6. The lamp assembly of claim 1 wherein a portion of each of said channels is restricted for snugly engaging respective lower portions of said lead wires.

7. The lamp assembly of claim 1 wherein the portions of said lead wires extending through said interior channels of said base have tabs for lockingly engaging said base.

8. The lamp assembly of claim 7 wherein said tabs each protrude from and engage the rear surface of said base.

* * * * *